United States Patent [19]

McInerny

[11] 4,416,449

[45] Nov. 22, 1983

[54] DOCUMENT SEPARATING APPARATUS AND METHOD

[75] Inventor: George P. McInerny, Andalusia, Pa.

[73] Assignee: Technitrol, Inc., Philadelphia, Pa.

[21] Appl. No.: 328,951

[22] Filed: Dec. 9, 1981

[51] Int. Cl.[3] ..... B65H 3/52

[52] U.S. Cl. ..... 271/122; 271/124

[58] Field of Search ..... 271/122, 121, 124, 125, 271/167

[56] References Cited

U.S. PATENT DOCUMENTS 3,944,210 3/1976 McInerny ..... 271/122 X 4,216,952 8/1980 McInerny ..... 271/122 X

*Primary Examiner*—Richard A. Schacher

*Attorney, Agent, or Firm*—John C. Dorfman

[57] ABSTRACT

A document separation device for separating documents in a stack employs counter-rotating drum and friction belt members to strip away and hold back more than a single document trying to pass between them. The structure employs a pair of friction drums and a free-wheeling pulley between them of slightly smaller diameter but on the same axis. Counter-rotating friction stripper belt is supported between two pulleys one of which is driven and is wrapped over the pulley between the friction drum members. A third rotatable pulley between the two supporting the friction belt is located opposite the free-wheeling pulley and has flanges which bear upon the friction drum surfaces such that the friction belt will normally not contact the third pulley when the friction belt is in direct contact with the idler between the friction drums. The friction belt is slightly slack. When a document passes between the belt and the friction drums, it moves the third pulley against the action of the tensioning means and causes the friction belt which is stretchable and resilient to become more taut. If the document is stiff it becomes further extended and the tautness is increased still further by the third member pressing against the stretchable friction belt on the opposite side of the pulley to provide two points of stretching.

16 Claims, 7 Drawing Figures

DOCUMENT SEPARATING APPARATUS AND METHOD

BACKGROUND OF THE INVENTION

The present invention relates to a mechanism and a method for assuring the separation of adjacent documents in a stack of documents. Ordinarily, such documents are processed through a machine which must, of necessity, first separate the documents from one another so that they may be individually counted or otherwise processed.

The present invention constitutes an improvement of the applicant's prior U.S. Pat. No. 4,216,952, issued Aug. 12, 1980, and assigned to the same assignee. Since that invention was made, various types of machines have been built by Technitrol, Inc., employing the invention. Such a commercial machine is illustrated in U.S. Pat. No. 4,253,615 for "Document Interleaver Device" issued on Mar. 3, 1981, to the inventor and Aaron F. Parker and assigned to the assignee of the present invention. Another machine made by Technitrol, Inc., is the subject matter of a currently pending patent application of the applicant and Nicholas P. Squillace Ser. No. 205,783, filed Nov. 10, 1980, for "Mechanism for Sequentially Separating Documents."

The present invention has been conceived in response to problems in connection with problems associated with machines built by the applicant's assignee Technitrol, Inc., for processing paper money. It will find particular application in connection with the handling of paper money. However, it is useful in other areas as well.

In the prior art, the structure described and shown in U.S. Pat. No. 4,216,952 has found particular application as a specific device in which two high friction drums placed side by side are opposed by a counter-rotating resilient friction stripper belt support between two pulleys one of which is driven. The belt is deflected and stretched taut over a free-wheeling pulley, coaxial with the drums, between the drums and of a slightly smaller diameter. The friction belt is driven in opposition to the friction drums which pull the document closest the drum along the document path. Such a structure works very well in connection with new money or with money in most conditions of use, as well as with stiffer documents of all sorts. However, recently, our government and, for a longer period of time other governments, have allowed paper money to continue circulating for such long periods of time that they become so limp that they develop a cloth-like texture and tend to conform closely to the shape of the surfaces by which they are contacted in the device. Currency or other documents which are limp tend to have a special problem relative to a tendency to curl and develop small tears along their edges. Additionally, the taut friction stripping belt used in the past tends to cause edges of limp bills to curl and the bills to skew as it forces the bills into conformance with the idler pulley between the friction drums. Skewing, in turn, can cause bills to partially overlap and produce errors in counting as well as resulting in problems in stacking.

In an effort to accommodate to the different conditions of currency, an adjustment has been provided on machines in the past which allows the stripping friction belt to be held taut when processing new currency or other types of firm documents and to be slackened somewhat when worn currency is introduced. However, the touch required to handle these extremes has proven somewhat critical and the required adjustment has not been made successfully in some instances, without taking great pains causing problems for the users of the various machines.

SUMMARY OF THE INVENTION

The present invention provides a way to use the same machine for new currency and other stiff documents and for old limp currency without adjustment or at least with only minor adjustment which is much less critical than adjustments which have had to be made in the past. The present invention employs a slack friction belt and interposes between the belt supporting pulleys a third idler pulley opposite the region where the belt wraps around the free-wheeling pulley between the friction drums. Opposition diameters of third pulley are preferably just bearly out of contact with the belt when no documents are passing through. The pulley has flanges, however, which contact respective friction drums and are urged into them by a spring support for the pulleys spindle. The spring yields as documents pass through so that the currency itself will determine whether the spring yields and how much the third pulley changes place in use. Specifically, because of the force of the friction belt on it, limp money conforms to idler pulley between the friction drum members and displaces the third pulley only the thickness of the money. As stiff currency passes through, however, the belt itself is lifted out of the groove and away from the belt deflecting idler pulley. Lifting the friction belt causes the belt to engage the third pulley which also displaces the third pulley toward the part of the belt at its opposite diameter. Thus, this action causes the belt to tension at that opposite side as well as at the place it is displaced by the money, and thereby even further increasing the tension which improves the stripping effect on the stiffer bills as they pass through. At such times the flanges of the pulley are capable of being lifted out of contact of the stiffer money. However, when the currency is limp, the flanges of the third pulley that would ordinarily rest on the friction drum surfaces now rests on part of the limp paper money on the opposite the friction drum surfaces and effectively act as guides to stabilize and provide equal forces to each drive to further help in preventing skewing of the money as it passes through.

In terms of broader scope, the present invention consists of document separation means for separating sheets from a stack. The means assuring separation of adjacent documents is supported on a support frame. A resilient continuous stretchable friction belt provides a first friction member and constitutes a self-adjusting member permitting accommodation of documents of different thickness and different surface friction characteristics. Two rotatable support and path defining means are provided on the frame for supporting said continuous stretchable friction belt. Two generally cylindrical friction drums of like diameter are rotatably supported on the support frame, each of the drums having a friction surface extending around the drum and together providing a second friction member. A non-friction belt deflection member coaxial with and between the two friction drums and of approximately the diameter of the friction drums but of smaller diameter, provides a surface over which the belt is deflected from a straight path between its supporting means into a conforming path over the non-friction surface. In this position, it is thereby supply forces acting normal to a sheet passing between the stretchable belt and the drums to generate frictional forces parallel to the sheet. Drive means is supplied on the support frame for driving the continuous stretchable belt through one of the rotatable support members in one direction and the two friction drums together in the opposite direction. Thus, the first and second friction members are moving in opposite directions over a sheet passing between them. A third rotatable means freely rotatable about an axix parallel to the drums and located between at least two rotatable support means of the friction belt. The third rotatable means is of a size to barely separate the portions of the stretchable friction belt at diametrically opposite points. Resilient support is provided on the support frame for a spindle about which the third rotatable means rotates whereby the third rotatable means is supported at the area of contact between the friction belt and the non-friction drum and urged toward the drum.

The method is also provided for separating documents using a friction drum which is opposed by a counter-rotating stripper friction belt deflected over a surface slightly smaller than the drum diameter. The method consists of driving the drum in the direction of desired document flow, driving the belt in the opposite direction, and guiding the document by pressure flanges of a pulley resiliently urged into the drums on each side of the friction belt. When documents are fed between the belt and drum, the flanges of the free wheeling pulley will hold the documents against the drum and prevent skewing.

Advantages are extended by providing the free wheeling pulley of proper dimensions such that it will touch both parts of the belt at oppositely spaced diametric positions when limp conforming paper passes between the belt and drums. When the pulley is moved against the belt by feeding documents between the belt and the friction drum, the documents act to move the friction belt away from smaller diameter surface and at the same time stretch the belt by pressure at the opposite side of the pulley against the belt and thereby increase the stripping effect.

BRIEF DESCRIPTION OF THE DRAWINGS

A preferred embodiment of the present invention is illustrated in the following diagrams in which:

FIG. 2 is a sectional view taken along line 2—2 of FIG. 1 showing the feed stripper with limp bills passing through;

DESCRIPTION OF THE PREFERRED EMBODIMENT OF THE PRESENT INVENTION

Figure 1:
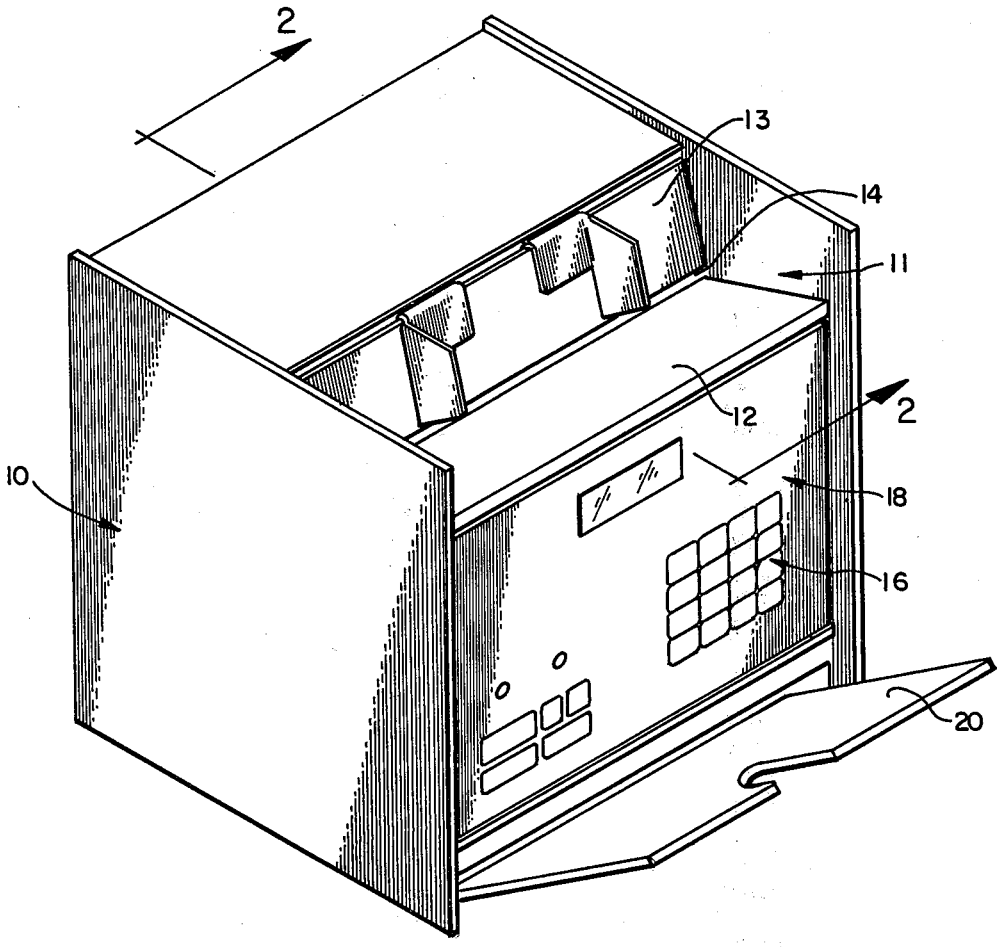
FIG. 1 is a perspective view of a machine employing the feed stripper structure of the present invention.

Referring to FIG. 1 a document processing machine illustrating one possible embodiment of the present invention is shown. The document processing machine generally represented at 10 has a housing and a frame which includes the sidewalls of the housing. The housing provides a document input bin 11 for a stack of document to supply the machine. Documents are supported upon a shelf 12 and rest against a back plane 13 which constitutes a portion of the structure. The particular device shown here is covered by co-pending U.S. patent application Ser. No. 205,783 of George P. McInerny and Nicholas P. Squillace, filed Nov. 10, 1980. When a stack of documents is placed on the self 11 of the input bin the bottom mosst document is fed through the opening 14 into the nip of the device of the present invention and thereafter is processed through the machine. The stripper device of the present invention prevents more than one document from passing through at a time.

Specific processing operations to be performed are controlled by a keyboard and pushbuttons 16 located on the front panel 18 of the document processing machine. After the processing operation is completed, the documents are discharged from the machine onto a collection tray 20.

Figure 2:
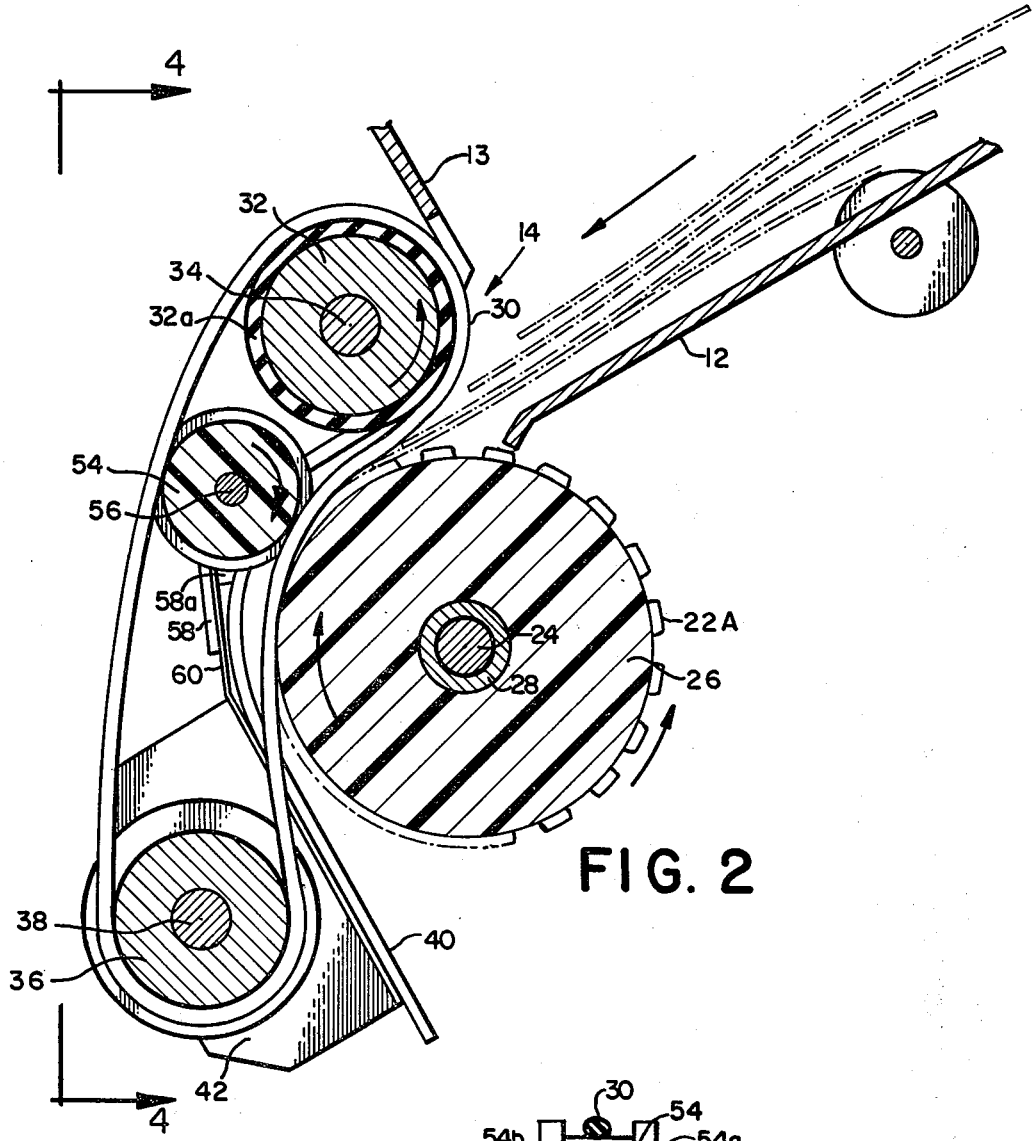
Figure 3:
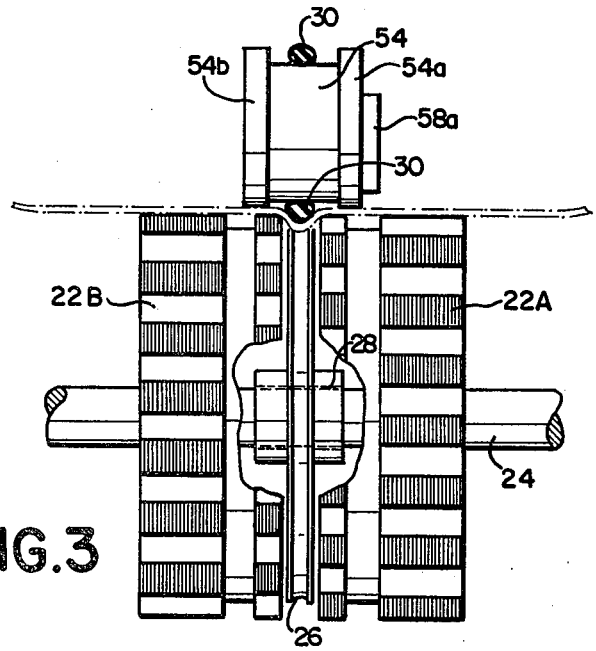
FIG. 3 is a view looking into the nip of the friction drums and stripper belt of FIG. 2 with the belt in section.
Figure 4:
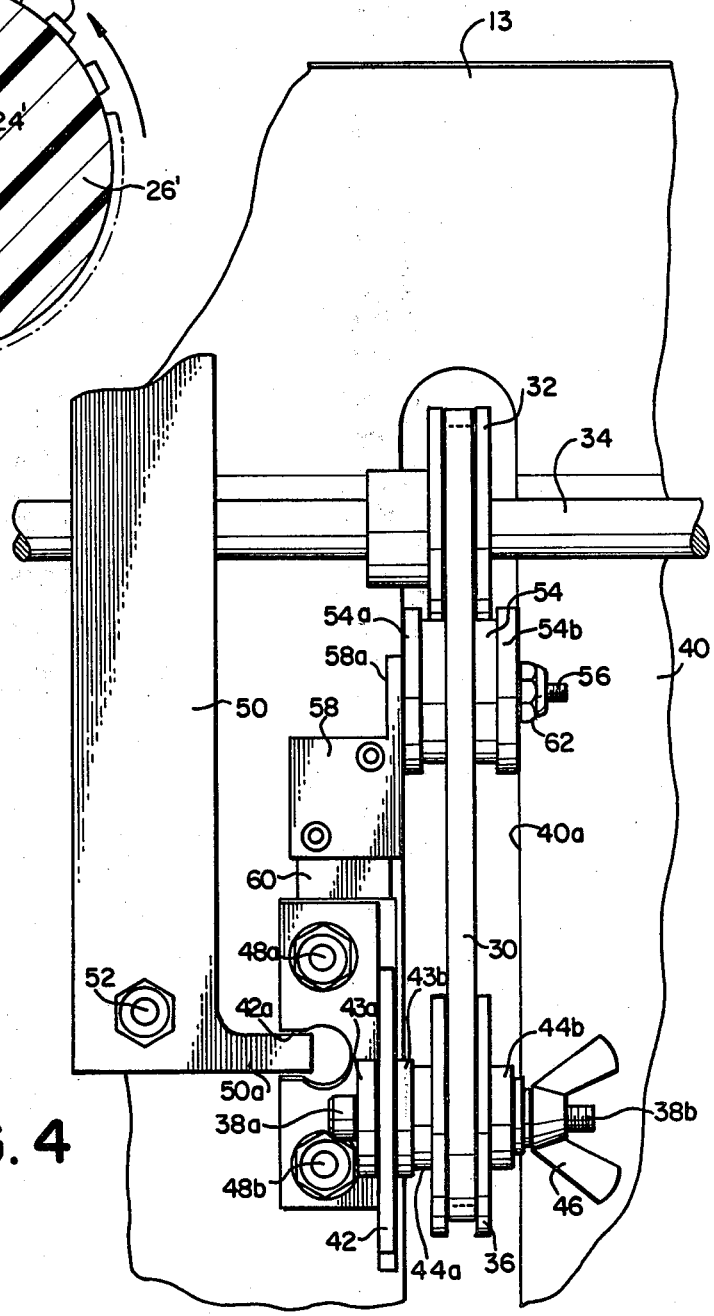
FIG. 4 is a partial back view of FIG. 5 viewed along line 4—4 of FIG. 2.

The actual document separating device of the present invention is seen illustrated in FIGS. 2, 3 and 4. Referring first to FIGS. 2 and 3, it will be seen that a shaft 24 supports the pair of friction drums 22A and 22B. The friction drums are typically metallic members fixed to the shaft to rotate together and having a outer periphery "tire" of polyurethane or some other high friction material. This is preferably in the form of a tread, with the treads being evenly spaced and parallel to the axis and the treads of one drum being offset from those of the other. The drums are separated from each other by a space along the shaft which is occupied by the free-wheeling idler pulley 26, the so-called non-friction belt deflection member, which is supported on the shaft by an oil impregnated bronze bearing 28. The support structure and other features are not illustrated because they have been shown in other applications and patents or have been referred to, particularly U.S. patent application Ser. No. 205,783.

The stripping friction belt 30 is preferably of a resilient stretchable deformable material such as rubber and may be provided with varying types of cross-section depending upon particular application. A preferred cross-section is rectangular to avoid conforming to the shape of the face of idler pulley 26 and minimize forces acting on a paper or bill opposing the drums on the drum side of the documents. The friction belt 30 is shown supported at one end on a drive pulley 32 having a rubber friction surface **32*a* at its outer periphery. The pulley 32 is fixed to the drive shaft 34 which is driven by drive means (not shown) and which, in turn, drives the friction belt 30. The friction belt is supported at its other end by an idler pulley 36 supported on shaft 38. In practice each of the pulleys 32 and 36 have flanges such as shown on pulley 36 but these are omitted in FIG. 2 from pulley 32 for the sake of clarity in this particular case, but seen in FIG. 4. Both pulleys 32 and 36 are supported on the frame and in this particular case supported from a back plane 40 of heavy aluminum sheet material which is slotted to permit passage of the belt and support structure where necessary. Backplane 40 is terminated at its upper end in the bin wall 13. The support for shaft 38 is a bracket 42**. It will be understood that suitable supports for all of the structure of this general type has been provided in practice and is well understood in the art.

The actual supporting structure of shaft 38 is shown in FIG. 4. FIG. 4 shows the supporting structure for the friction belt 30 viewed from the backside or to the left of FIG. 1. FIG. 4 also shows the slotting 40*a* of backplane 40 in order to permit the passage of the belt in its supporting structure. As seen in FIG. 4, pulley 36 is supported on shaft 38 by a variety of pieces. The shaft 38 itself is provided with a head 38*a* and a threaded end shank 38*b*. The shaft is first passed through a washer 43*a* placed through a slot in bracket 42 and then through another washer 43*b*, which preferably has a tubular extension closely embracing the shaft. Over this tubular extension is placed washer 44*a*, then pulley 36 then finally washer 44*b*. Holding the assembly in place with suitable spring washers or other intermediate means is a wing nut 46. The tubular extension of member 43*b* terminates short of washer 44*b* which closely engages the shaft 38 and permits pressure to be transmitted from the wing nut 46 to clamp the washers against bracket 42 without binding pulley 36. In the prior art this kind of structure was highly desirable in order to slacken the belt for flexible documents or to tighten the belt for stiffer ones depending upon different applications in which the device was used. A slot in bracket 42 runs generally in the direction of extension of the belt 30 to enable the pulley 36 to be moved up or down. The slot can be shortened considerably in the structure of the present invention. But adjustment is still made by loosening the wing nut 46 and the pulley spindle 38 is held in place when wing nut 46 is tightened. In the present invention such adjustment is still of some convenience but of much less importance and once made it may be generally left without adjustment over long periods of use.

It will be observed that the supporting bracket 42 is a part of an angle iron the base portion of which is supported on the backplane 40 by suitable fasteners 48*a* and 48*b* which preferably employ spring washers, such as bell washers, to enable the device to be moved under a leverage force. This kind of movement permits a fine tensioning adjustment of the belt, which is still desirable but not nearly as critical as it was in the prior art. Furthermore, the range of such adjustment may be substantially reduced. The fasteners 48*a* and 48*b* are connected to the backplane 40 through slots (not shown). Adjustment of the bracket along these slots is accomplished by use of the lever 50 which moves about pivot point 52 attaching the lever to the backplane 40 attached to lever 50 is a crank arm 50*a*. Crank arm 50*a* engages the sidewalls of a rounded slot 42*a* to move the supporting bracket 42 up and down as desired.

FIGS. 2, 3 and 4 show the pulley 54, the third rotatable means, rotatably supported on the shaft 56 for rotatable movement in a free-wheeling way. The pulley can conveniently be made of moldable plastic material such as Delrin®. Pulley 54 is provided with flanges 54*a* and 54*b* which are spaced apart sufficiently to give wide clearance of the belt 30 and so that each rides on a portion of the tread of the friction rolls 22A and 22B, respectively. The pulley diameter preferably is such as to not contact but remain spaced from the belt in the slack belt situation of the present invention when no document is passing through. Otherwise stated, the pulley 54 preferably does not apply tension to the belt in the position where there is no paper passing through the nip of the belt and the friction drums 22A and 22B.

Shaft 56 of the pulley 54 is supported on a flange 58*a* of bracket 58 which, in turn, is supported by a spring member 60 affixed to the wall 40. The spring support structure is of such length as to position the pulley in the vicinity of the mid point of the wrap around of the friction belt 30 on the pulley 26 intermediate the drums 22A and 22B. The spring 60 is biased to urge the flanges 54*a* and 54*b* into contact with the friction surfaces of the drums 22A and 22B, respectively, but is designed to permit the idler pulley 54 to move away from the drums as paper passes through. The pulley 54 is of such a diameter that it contacts the friction belt 30 at its outside, remote from the friction drums only slightly, if at all, in the slack condition of the belt when no documents are passing through. If contact is permitted, it is certainly not sufficient to increase tension in the friction belt 30. Some variation in this is permissible but the optimum would be to have no tension applied in the condition where no documents are passing between the belt and the drum.

Figure 5:
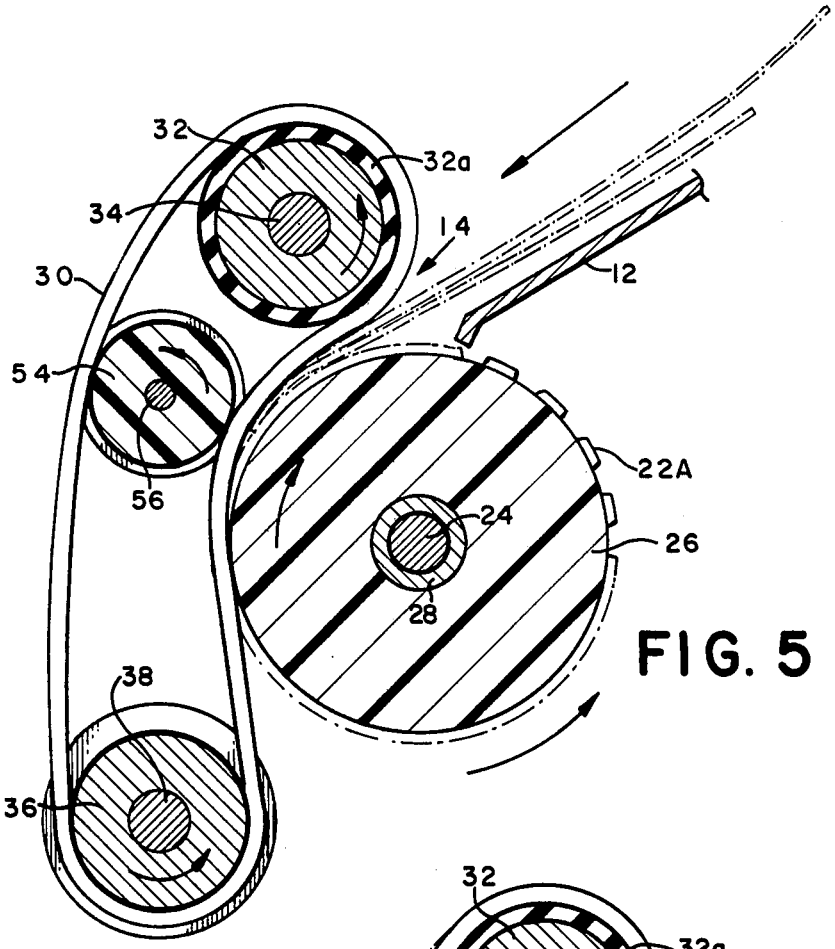
FIG. 5 is a sectional view similar to FIG. 2 with stiff bills beginning to pass through the feed stripper area.

FIG. 2 shows the paper just entering the nip between the belt and friction roll but FIG. 3 shows the paper within the nip. In the case of FIG. 3 the paper illustrated is intended to represent thin highly flexible paper such as old worn out bills. Under such circumstances, the belt 30 tends to pull the bill tightly against the low friction surface of free-wheeling pulley 26. FIG. 5 on the other hand is intended to represent the situation where a bill or paper is more or less firm unyielding as in the case of new currency or computer cards. In such case, the belt is lifted completely off of the pulley 26 and is therefore stretched and caused to tighten more because it is lifted off the pulley. At the same time, the pulley 54 is moved outwardly against the belt and stretches the outer portion of the belt as well, producing further tension in the belt at that point. Thus, a double tensioning effect is achieved causing the stripping effect acting to separate documents to be increased.

Various possibilities are inherent in the use of the separate pulley 54 as a third member within and engaging the tension belt 30. The preferred one of these possibilities is that the flanges are made sufficiently shallow so that they engage the drum or the paper when the belt 39 is well into the groove conforming to and holding a document against the idler pulley 26. However, the flanges are lifted off of the paper when the pulley 54 is moved away from the paper by the raising of the belt 30 out of the groove by a stiffer document. Thus, as seen in FIG. 3, where the paper is flexible, the belt cannot lift the flanges of the pulley off the paper and the pulley 54 is driven by the drum in such a direction as to aid the movement of the paper. Both flanges 54*a* and 54*b* are actually driven at the same speed by the paper a it passes through the nip in opposition to the direction of movement of the friction belt 30. Therefore, the flanges tend to equalize the rate of movement of the separated parts of the paper they contact and prevent skewing.

Figure 6:
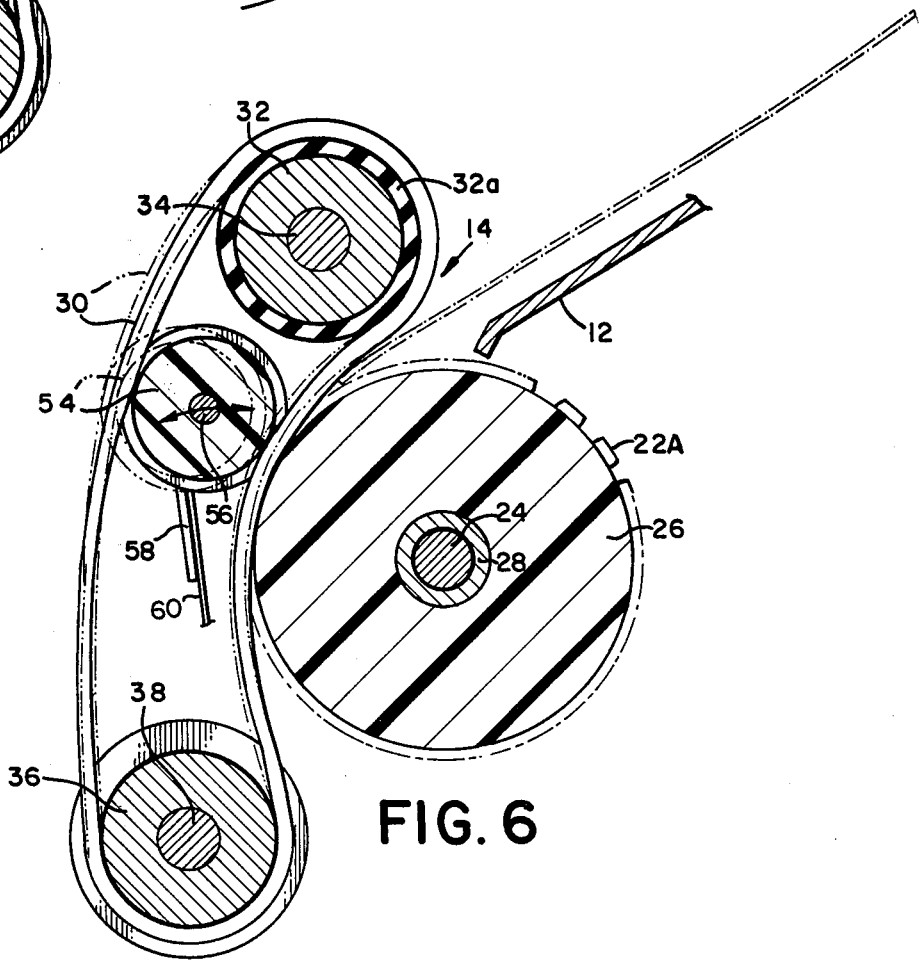
FIG. 6 is a sectional view composite of FIGS. 2 and 4 showing the stripper belt in position to handle limp bills in full lines and in position to handle stiff bills in phantom.

FIG. 6 is intended to show the two operating positions of the pulley. That is, the solid line position represents that position of the pulley which is assumed when no paper is passing through or when the paper is extremely thin and flexible and assumes the kind of contour shown in FIG. 3. In the case of the stiffer paper passing through as in the case illustrated by FIG. 5, however, the belt is deflected into the dot and dash position as the pulley 54 is moved away from the drum. The pulley is preferably made of Delrin ® or some low friction plastic.

It is also possible to provide a pulley which, in effect, is a spool having the two flanges connected together and free-wheeling over the shaft and a center rotating tubular bearing member restrained within the flanges to rotate separate from the flanges, possibly in opposite directions from the direction of rotation of the flanges.

Figure 7:
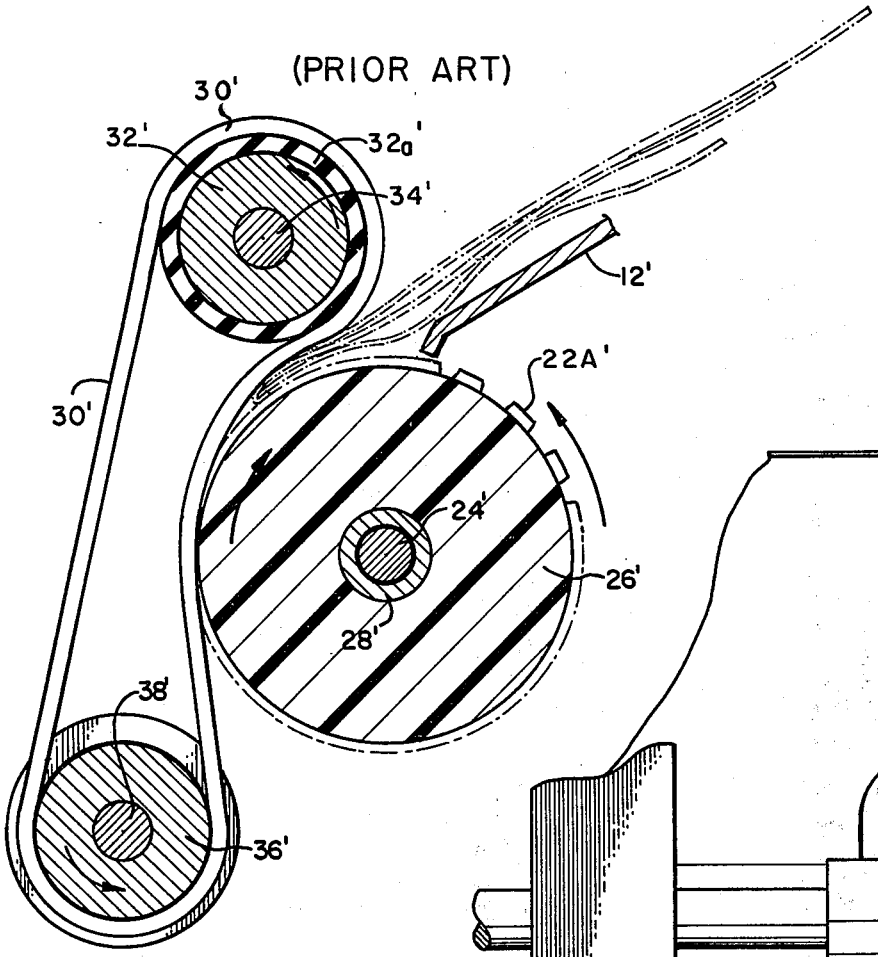
FIG. 7 is a view similar to FIGS. 2, 5 and 6 showing the prior art arrangement.

Operation of the device is considered in terms first of the prior art device shown in FIG. 7. Parts in FIG. 7, because it has essentially the same parts as the other structures, but omits the idler roller 54, has its parts designated by the same number designators but with the addition of primes thereto, so that the parts can more easily be directly compared. Considering the operation of the system shown in FIG. 7, it will be clear that when old limp bills are used the friction belt 30' will tend to pull them down into the idler pulley 26' so that they assume a position similar to that shown in FIG. 3. When a limp bill is held against the center idler or free-wheeling pulley 26 due to the taut counter-rotating stripper belt 30, the leading edges tend to curl and the bill tends to wrinkle as shown in FIG. 7. In addition, a condition that is particularly difficult to handle is the skewing of bills under these circumstances because the limp bills in wrinkling or not exposing completely uniform surfaces tend to twist as they reach the belt. Skewing produces various undesirable effects so that the bills may overlap and, for example, improper counts may be given where there is no space between adjacent bills passing through machine. The addition of the compensating idler 54 as seen in FIGS. 2, 3, and 4 helps avoid this situation. The action of spring 60 tends to urge the flanges of compensating idler 54 into the drum surfaces **22*a* and 22*b* and into any paper which is on those drum surfaces if the paper is limp as illustrated in connection with FIG. 3. In such operation, the compensating idler 54 is preferably out of contact, or substantial contact with the belt 30. Only when the belt 30 is lifted by stiffer paper as shown in FIG. 5 do the flanges leave the surface of the paper. At that time the belt itself is lifted to the level of the friction drum surfaces 22*a* and 22*b* thereby stretching the belt and increasing its friction effect in opposition to the passage of double sheet material so that double thicknesses of the sheet material are resisted and actually held back by the stripper belt. Preferably when no bills are being fed between the friction rollers 22*a* and 22*b* and the stripper friction belt 30, the circumference of the idler 54 clears the inside surface of the stripper belt. This allows the feed roller to drive the idler without exerting any pinch between the idler and the stripper belt. Idler 54** as previously indicated is made of low friction material such as Delrin ® so that no significant wear will occur if contact is made between the stripper belt and the circumference of the undercut at the time when the stripper belt is running in counter-rotation to the idler.

As seen in FIG. 3, when a worn limp bill passes between the feed the stripper belt 30 and the friction drums 22A and 22B, it will gradually form a crease between the belt 30 and the pulley 26 due to the cloth-like quality of the bill. With the addition of the compensating idler 54, the stripper belt is allowed to be set slack so that little pinch is inserted between the belt and the center idler 26 allowing the bill to move freely to the nip of idler 54. As seen in FIG. 6, the stripper belt must tighten somewhat as bills wrap around the feed roller due to the increase in diameter caused by the thickness of the bills causing the stripper friction belt 30 to lift away from the idler 24.

The idler 54 has its flanges **54*a* and 54*b* bearing on the bill at the critical point where buckling and skewing of the limp bills normally occurs. Little stripping force is required on limp bills. Therefore, if a slack stripper actually imposes required friction on stripper belt 30. Meantime, the flanges 54*a* and 54*b* claiming the bill to the friction drums help to prevent skew which might otherwise occur. When a new bill passes between the stripper belt and the feed rollers as shown in the dot and dashed lines of FIG. 6 due to its stiffness, the stripper belt is lifted completely out of the gap between the feed rolls 22*a* and 22*b* as can be seen from observing FIG. 3. This increase in the circumference by the gap depth and the bill thickness causes the belt to tighten. The inside surface of the friction stripper belt 30 also contacts the outer circumference of the undercut reversing the direction of the idler 54 and lifting the flat spring 60 and its bracket assembly causing the idler to deform the belt on the side opposite from the feed roller which increases the tightening even more. The double action allows a small lifting of pulley 54 to cause a significant amount of stripper belt tensioning. The tensioning in this case then is optimum for the new bills which are being fed through. The outer circumference of the flanges 54*a* and 54*b*** does not contact the new bill or the feed rollers. This is an ideal condition because stiff bills do not require assistance in passing between the free stripper area and allowing the idler to rotate with the taut stripper belt reduces a belt wear problem.

It will be understood that the stripper belt tension requirement is generally proportional to the stiffness of the bills and the degree of compensation is adjusted by bill passing through the feed stripper. Therefore, the increase can cause an optimum tensioning of the stripper belt across the whole range from new to worn limp bills.

Several embodiments of the present invention have been shown or suggested. Others will occur to those skilled in the art. All such modifications, changes and further embodiments of the invention within the scope of the claims are intended to be within the scope and spirit of the present invention.

I claim:

1. A document separation means for separating sheets from a stack and assuring separation of adjacent documents comprising:

a support frame;

a resilient continuous stretchable friction belt, providing a first friction member and constituting a self-adjusting member permitting accommodation of documents of different thickness and different surface friction characteristics;

two rotatable support and path defining means on the frame for supporting said continuous stretchable friction belt;

two coaxial generally cylindrical friction drums of like diameter rotatably supported on the support frame, each having a friction surface extending around the drum and together providing a second friction member;

a non-friction belt deflection member coaxial with and between the two friction drums and of approximately the diameter of the friction drums but of smaller diameter over the surface of which non-friction member the belt is deflected from a straight path between support means into a conforming path over the non-friction drum surface to thereby supply forces acting normal to a sheet passing between the stretchable belt and the drums to generate frictional forces parallel to the sheet;

drive means on the support frame for driving the continuous stretchable belt through one of the rotatable support members in one direction and the two friction drums together in the opposite direction, such that the first and second friction members are moving in opposite directions over a sheet passing between them;

a third rotatable means freely rotatable about a parallel axis and located between the two rotatable support means of a size to engage and separate portions of the stretchable friction belt at diametrically opposite points; and resilient support from the support frame spindle about which the third rotatable means rotates, whereby the third rotatable means is supported at the area of control between the friction belt and the non-friction drum and urged toward said drum.

2. The document separation system of claim 1 in which intervention of a sheet between the drum and the resilient continuous stretchable friction belt further increases the belt tension and the friction forces.

3. The document separation system of claim 1 in which the non-friction belt deflection member is separately rotated about the same axis as the friction drums but is not driven.

4. The document separation system of claim 3 in which the non-friction belt deflection member is a free-wheeling pulley means capable of rotating with the friction belt.

5. The document separation means of claim 4 in which the friction drums are fixed to a driven axle about which the free-wheeling pulley rotates.

6. The document separation system of claim 5 in which the friction surface of the drum is provided with a tread surface.

7. The document separation system of claim 3 in which the drive means for the friction belt is applied at that rotatable support and path defining means immediately following the friction drums in the direction of belt rotation, whereby resistance to separation of documents causes the friction belt to stretch and apply more force, thereby increasing the force tending to separate the documents.

8. The document separation means of claim 1, 3 or 4 in which the third rotatable means is of a diameter such that as documents pass between the friction drums and the friction which lift the belt away from the non-friction belt deflection member, the resilient support will allow the third rotatable means to be moved away as well thereby further deflecting the friction belt portion in contact at the diametrically opposite point and further stretching the belt in that location as well in the portion adjacent the friction drums.

9. The document separation means of claim 4 in which the third rotatable means is a pulley, the flanges of which normally engage the friction surfaces of friction drums.

10. The document separation system of claim 9 in which the flanges of the third rotational means engage the documents passing through and aid in keeping them straight.

11. The document separation means of claim 9 in which the pulley constituting the third rotable means no more than barely engages the friction belt on the side adjacent to the friction drums.

12. The document separation means of claim 7 in which the third rotatable means is a pulley constituting the third rotatable means engages the friction belt when documents pass through in such a way that being driven by its flanges in opposition to the friction belt pulley imparted to the friction belt further stretches the belt in the region.

13. The document separation means of claim 12 in which the flanges of the third rotatable means are of such dimension that they are lifted off the document when the belt is held by relatively stiff documents at the diameter of the friction drums.

14. The document separation means of claim 13 in which if the document is deformed by the friction belt to the surface of the non-friction belt deflection means, the flanges of the third rotatable means will engage and help guide the flexible document.

15. The method of separating documents using a friction drum which is opposed by a counter-rotating stripper friction belt deflected over a non-friction surface slightly smaller than drum diameter intermediate the length of the drum axis comprising:

driving the drum in the direction of desired document flow;

driving the belt in the opposed direction;

guiding the documents by flanges of a free-wheeling pulley urged into the drum each side of the belt; and feeding documents between the belt and the drum whereby the flanges of the free-wheeling pulley will hold the document against the drum to prevent skewing.

16. The method of claim 15 in which the free-wheeling pulley is of proper dimensions so that moving the pulley against the belt by feeding documents between belt and friction drum will stretch the belt and increase the stripping effect.

* * * * *